US005577725A

United States Patent [19]

Pagotto et al.

[11] Patent Number: 5,577,725

[45] Date of Patent: Nov. 26, 1996

[54] HOCKEY STICK HANDLE

[75] Inventors: John Pagotto, Ville Mont-Royal; Alain Bellefleur, St-Luc, both of Canada

[73] Assignee: Tropsport Acquisitions Inc., Lachine, Canada

[21] Appl. No.: 566,803

[22] Filed: Dec. 4, 1995

[30] Foreign Application Priority Data

Sep. 22, 1995 [CA] Canada ..... 2158898

[51] Int. Cl.[6] ..... A63B 59/14

[52] U.S. Cl. ..... 273/67 A

[58] Field of Search ..... 273/67 R, 67 A, 273/75, 73 J; 81/489

[56] References Cited

U.S. PATENT DOCUMENTS

| | | |
|---|---|---|
| 4,351,528 | 9/1982 | Duplin . |
| 4,358,113 | 11/1982 | McKinnon et al. . |
| 4,470,599 | 9/1984 | Usher, Jr. . |
| 4,583,734 | 4/1986 | Pawlicki et al. . |
| 5,036,003 | 4/1994 | Pagotto . |
| 5,312,100 | 5/1994 | Ilacqua et al. . |
| 5,423,531 | 6/1995 | Hoshizaki et al. . |

FOREIGN PATENT DOCUMENTS

| | | | |
|---|---|---|---|
| 2472939 | 7/1981 | France . | |
| 2610835 | 8/1988 | France | 273/67 A |
| 4019039.0 | 12/1991 | Germany . | |
| 7802876 | 9/1978 | Netherlands | 273/67 A |
| 8900951 | 11/1990 | Netherlands . | |
| 2205757 | 12/1988 | United Kingdom | 273/67 A |

*Primary Examiner*—Mark S. Graham

*Attorney, Agent, or Firm*—Ronald S. Kosie; Robert Brouillette

[57] ABSTRACT

The present invention, relates to a hockey stick shaft or handle having both a forward and a rear gripping zone. The gripping zones each have elongated opposed faces which are of different configuration from each other. For example each gripping zone may be provided with opposed concave and convex faces but wherein the faces of one gripping zone are disposed in reversed relative relation to the other gripping zone in order to accomodate the different gripping position of each hand of a user. A hockey stick provided with such a handle may provide a sense of a better or more comfortable feel on the gripped portion of the handle and/or a sense of a more comfortable and precise control of a blade which may be fixed to the end of such a handle.

29 Claims, 5 Drawing Sheets

9
9b
10b
11
12
13
14
15
16
30
30a
31
31a
32
32a
33
33a
34
34a
35
35a
36
36a
37
37a
6
6b
7b

HOCKEY STICK HANDLE

The present invention relates to game stick shafts and in particular to shafts or handles for hockey sticks or the like.

Hockey sticks generally consist of two basic elements, namely an elongated handle component and a blade secured to the forward end of the handle. Hockey stick handles or shafts which have a more or less substantially rectangular cross-section are preferred by hockey players since such a shaft affords the user a relatively comfortable grip in addition to providing him with a certain degree of awareness of and control over the orientation of the blade at the end of the shaft, i.e. when the blade is in contact with an ice hockey puck.

Known hockey stick handles have a forward gripping part and a rear gripping part which have the same configuration; see for example U.S. Pat. Nos. 4,358,113, and 5,312,100. Such a uniform configuration does not address the problem of how to satisfy the separate and different (i.e. reverse) gripping postures of the right and rear hands so that both of a user's hands have a relatively comfortable grip in addition to contributing a certain degree of control over and awareness of the orientation of the blade.

U.S. Pat. No. 5,423,531, for example, discloses a rectangular hockey stick handle having a rear or top end and a forward or blade end, the forward end being configured to engage a blade. The handle shown may be used by a "left hand" player, i.e. by a user who grips a forward part of the handle by the left hand and a rear part of the handle by the right hand. The handle is taught as having opposed front and rear faces. The front face of the handle is concave and the rear face of the handle is convex; the concave configuration extends the entire length of the front face of the handle from the top end thereof to the forward end; similarly, the opposed convex configuration extends the entire length of the rear face of the handle from the top end thereof to the forward end.

It would be advantageous to have an elongated handle for a hockey stick or the like which has a surface contour which may provide a sense of increased gripping comfort and/or control of the blade at the rear end of the handle as well as at the forward or front end thereof, e.g. increased comfort for both hands.

SUMMARY OF THE INVENTION

Generally, in accordance with the present invention, there is provided a hockey stick handle of rectangular configuration having a rear end and a forward end, said forward end being configured for engaging a blade having a first broad blade face and an opposed second broad blade face, said handle having, a pair of opposed narrow sides comprising a top narrow side and a lower narrow side, a pair of opposed broad sides comprising a first broad side and a second broad side, the first and second broad sides being configured to merge respectively with the first and second broad blade faces of a said blade for forming a hockey stick comprising said handle and said blade the improvement wherein said handle comprises a forward gripping zone for being gripped by one hand of a user a rear gripping zone for being gripped by the user's other hand and an intermediate transition zone connecting the forward and rear gripping zones together, said forward gripping zone comprising a first forward elongated face and a second forward elongated face, each of said forward faces extending forwardly from said transition zone, each of said forward faces being independently selected from the group of configurations comprising a forward elongated concave face, a forward elongated convex face and a forward elongated planar face, said rear gripping zone comprising a first rear elongated face and a second rear elongated face, each of said rear faces extending rearwardly from said transition zone, each of said rear faces being independently selected from the group of configurations comprising a rear elongated concave face, a rear elongated convex face and a rear elongated planar face, said first broad side comprising the first forward elongated face and the second rear elongated face, said second broad side comprising the second forward elongated face and the first rear elongated face, and the first forward elongated face of the forward gripping zone having a configuration different from that of the second forward elongated face of the forward gripping zone, the first rear elongated face of the rear gripping zone having a configuration different from that of the second rear elongated face of the rear gripping zone, the forward elongated face of the first broad side having a configuration different from that of the rear elongated face of the first broad side, and the forward elongated face of the second broad side having a configuration different from that of the rear elongated face of the second broad side.

In accordance with the present invention the forward gripping zone may extend from the transition zone right up to the forward end of the handle. Alternatively, as necessary or desired the forward gripping zone may extend from the transition zone to some intermediate point between the transition zone and the forward end of the handle. Thus, the forward elongated faces of the forward gripping zone may both extend, independently of one another, (i.e. the same or different distances) from the transition zone to some intermediate point between the transition zone and the forward end of the handle or they may both extend from the transition zone right up to the forward end of the handle.

Similarly, the rear gripping zone may extend from the transition zone right up to the rear end of the handle. Alternatively, as necessary or desired the rear gripping zone may extend from the transition zone to some intermediate point between the transition zone and the rear end of the handle. Thus, the rear elongated faces of the rear gripping zone may both extend, independently of one another, (i.e. the same or different distances) from the transition zone to some intermediate point between the transition zone and the rear end of the handle or they may both extend from the transition zone right up to the rear end of the handle.

In any case, each of the gripping zones is to be configured keeping in mind its function, i.e. to provide a hand grip contoured as described herein.

The first broad blade face may as desired be the front blade face which usually is used to impact a puck and the second broad blade face may be the opposed rear blade face; alternatively, the first broad face may be the rear blade face and the second broad face may be the front face of the blade. Accordingly, in relation to any particular blade construction (e.g. flat or curved) a particular configuration of an elongated face of a gripping zone may be disposed either on the broad side of the handle merging with the front broad face or, if desired, with the rear or back broad blade face.

For example, a handle for a right hand hockey stick having a curved blade, may have a rear gripping zone having an elongated convex face and an opposed elongated concave face. Preferably, the concave face may be disposed on the broad side of the handle which merges with the rear blade face while the convex face is on the other broad side. Alternatively, the concave face may be disposed on the broad side of the handle which merges with the front blade face while the convex face is on the other (i.e. rear) broad side.

In accordance with the present invention a rear gripping zone may have the same relative but opposite configuration as a forward gripping zone; i.e. the concave/convex/planar faces of one gripping zone may be in reversed relation relative to the concave/convex/planar faces of the other gripping zone on the other side of the transition zone. Alternatively, the forward and rear gripping zones may have altogether different relative configurations.

In accordance with the present invention, for each of the gripping zones, one of the elongated faces thereof may have a planar configuration and the other elongated face thereof may have a different configuration, i.e. a concave or a convex configuration. In accordance with the present invention, it is to be understood that the characterisation of a face as having an elongated planar configuration means that such a planar face includes a face having a substantially or essentially flat aspect, i.e. a surface aspect which to a player is for all intents and purposes flat even though the face may theoretically have a slight curvature. A flat or planar face is, for example, one which meets the manufacturing tolerances usually applicable to the manufacture of known rectangular hockey stick handles having planar sides (e.g. the deviation, of a central part of an essentially or substantially flat face, from the plane defined by opposed outer corner portions attached thereto may, for example, be 0.010 to 0.009 inches or less, e.g. 0.008 to 0.004 inches). Thus, for example, a concave face herein may be one wherein a central part thereof may deviate inwardly from the plane defined by opposed outer corner portions attached thereto into the body of the handle by, for example, 0.010 inches or more (e.g. 0.025 inches); similarly, for example, a convex face herein may be one wherein a central part thereof may deviate outwardly from the plane defined by opposed outer corner portions attached thereto away from the body of the handle by, for example, 0.010 inches or more.

In accordance with the present invention, the handle configuration may be such that, for example, a) the forward gripping zone may comprise a forward elongated planar face and a forward elongated convex face, each of said forward faces extending forwardly from said transition zone, and the rear gripping zone may comprise a rear elongated planar face and a rear elongated convex face, each of said rear faces extending rearwardly from said transition zone, said first broad side comprising the forward elongated planar face and the rear elongated convex face, the second broad side comprising the forward elongated convex face and the rear elongated planar face; or b) the forward gripping zone may comprise a forward elongated concave face and a forward elongated planar face, each of said forward faces extending forwardly from said transition zone, and the rear gripping zone may comprise a rear elongated concave face and a rear elongated planar face, each of said rear faces extending rearwardly from said transition zone, said first broad side comprising the forward elongated concave face and the rear elongated planar face, the second broad side comprising the forward elongated planar face and the rear elongated concave face; or c) the forward gripping zone may comprise a forward elongated concave face and a forward elongated convex face, each of said forward faces extending forwardly from said transition zone, and the rear gripping zone may comprise a rear elongated concave face and a rear elongated planar face, each of said rear faces extending rearwardly from said transition zone, said first broad side comprising the forward elongated concave face and the rear elongated planar face, the second broad side comprising the forward elongated convex face and the rear elongated concave face; or d) the forward gripping zone may comprise a forward elongated planar face and a forward elongated concave face, each of said forward faces extending forwardly from said transition zone, and the rear gripping zone may comprise a rear elongated concave face and a rear elongated planar face, each of said rear faces extending rearwardly from said transition zone, said first broad side comprising the forward elongated concave face and the rear elongated planar face, the second broad side comprising the forward elongated planar face and the rear elongated concave face; or e ) etc . . .

The present invention in accordance with a particular aspect provides a hockey stick handle of rectangular configuration having a rear end and a forward end, said forward end being configured for engaging a blade having a first (e.g. front) broad blade face and an opposed second (e.g. back) broad blade face, said handle having, a pair of opposed narrow sides comprising a top narrow side and a lower narrow side, a pair of opposed broad sides comprising a first broad side and a second broad side, the first and second broad sides being configured to merge respectively with the first and second back broad blade faces of a said blade, for forming a hockey stick comprising said handle and said blade the improvement wherein said handle comprises a forward gripping zone for being gripped by one hand of a user a rear gripping zone for being gripped by the user's other hand and an intermediate transition zone connecting the forward and rear gripping zones together, said forward gripping zone comprising a forward elongated concave face and a forward elongated convex face, each of said forward faces extending forwardly from said transition zone, said rear gripping zone comprising a rear elongated concave face and a rear elongated convex face, each of said rear faces extending rearwardly from said transition zone, said first broad side comprising the forward elongated concave face and the rear elongated convex face, the second broad side comprising the forward elongated convex face and the rear elongated concave face.

In accordance with the present invention, as mentioned above, a forward elongated concave face and a forward elongated convex face of the forward gripping zone may extend from the transition zone right up to the forward end; alternatively, as necessary or desired these forward faces may each, independently of each other, extend as described above from the transition zone to some intermediate point between the transition zone and the forward end of the handle. Similarly, a rear elongated concave face and a rear elongated convex face of the rear gripping zone may extend from the transition zone right up to the rear end of the handle; alternatively, as necessary or desired these rear faces may also extend, independently of each other, as described above from the transition zone to some intermediate point between the transition zone and the rear end of the handle.

As mentioned above, a rear gripping zone may have the same relative but opposite configuration as a forward gripping zone. Alternatively, the forward and rear gripping zones may have different relative configurations, e.g. any concave parts may have different radii of curvature, the radii of the corresponding corner portions may be different, one of the faces may be planar and the other three may be curved, etc. . . .

In accordance with the present invention a concave face of the forward gripping zone may have a radius of curvature the same as or different from the radius of curvature of a concave face of the rear gripping zone.

In accordance with the present invention, a concave face of the forward gripping zone may have a radius of curvature larger than the radius of curvature of a convex face thereof and a concave face of the rear gripping zone may have a radius of curvature larger than the radius of curvature of a convex face thereof.

As mentioned above an elongated face may be planar.

Thus, in accordance with another aspect the present invention provides a hockey stick handle of rectangular configuration having a rear end and a forward end, said forward end being configured for engaging a blade having a first (e.g. front) broad blade face and an opposed second (e.g. back) broad blade face, said handle having, a pair of opposed narrow sides comprising a top narrow side and a lower narrow side, a pair of opposed broad sides comprising a first broad side and a second broad side, the first and second broad side being configured to merge respectively with the first and second broad blade faces of a said blade, for forming a hockey stick comprising said handle and said blade the improvement wherein said handle comprises a forward gripping zone for being gripped by one hand of a user a rear gripping zone for being gripped by the user's other hand and an intermediate transition zone connecting the forward and rear gripping zones together, said forward gripping zone comprising a forward elongated planar face and a forward elongated convex face, each of said forward faces extending forwardly from said transition zone, said rear gripping zone comprising a rear elongated planar face and a rear elongated convex face, each of said rear faces extending rearwardly from said transition zone, said first broad side comprising the forward elongated planar face and the rear elongated convex face, the second broad side comprising the forward elongated convex face and the rear elongated planar face.

In accordance with a further aspect the present invention provides a hockey stick handle of rectangular configuration having a rear end and a forward end, said forward end being configured for engaging a blade having a first (e.g. front) broad blade face and an opposed second (e.g. back) broad blade face, said handle having, a pair of opposed narrow sides comprising a top narrow side and a lower narrow side, a pair of opposed broad sides comprising a first broad side and a second broad side, the first and second broad side being configured to merge respectively with the first and second broad blade faces of a said blade, for forming a hockey stick comprising said handle and said blade the improvement wherein said handle comprises a forward gripping zone for being gripped by one hand of a user a rear gripping zone for being gripped by the user's other hand and an intermediate transition zone connecting the forward and rear gripping zones together, said forward gripping zone comprising a forward elongated concave face and a forward elongated planar face, each of said forward faces extending forwardly from said transition zone, said rear gripping zone comprising a rear elongated concave face and a rear elongated planar face, each of said rear faces extending rearwardly from said transition zone, said first broad side comprising the forward elongated concave face and the rear elongated planar face, the second broad side comprising the forward elongated planar face and the rear elongated concave face.

In accordance with the present invention a first corner portion may connect the first broad side to the top narrower side, a second corner portion may connect the first broad side to the lower narrow side, a third corner portion may connect the second broad side to the lower narrow side, and a fourth corner portion may connect the second broad side to the top narrow side.

In accordance with the present invention, for either gripping zone, the first, second, third and fourth corner portions may each have the same or different radius of curvature. The radius of curvature of the first and second corner portions may for example as a group have a radius of curvature different from that of the third and fourth corner portions; in this case, for example, the radius of curvature of the first corner portion may be the same or different from that of the second corner portion; similarly, for example, the radius of curvature of the third corner portion may be the same or different from that of the fourth corner portion.

Thus, for example, in accordance with the present invention, for the forward and rear gripping zones the first and second corner portions may each have the same radius of curvature and the third and fourth corner portions may each have the same radius of curvature, the radius of curvature of the first and second corner portions being different from the radius of curvature of the third and fourth corner portions.

The forward gripping zone may have a first corner portion which has a radius of curvature smaller than the fourth corner portion; and the rear gripping zone may have a first corner portion which has a radius of curvature greater than the fourth corner portion.

Furthermore, the forward gripping zone may have a second corner portion which has a radius of curvature smaller than that of the third corner portion, and the rear gripping zone may have a second corner portion which has a radius of curvature greater than that of the third corner portion.

Thus, for example, in accordance with the present invention, for the forward gripping zone the first and second corner portions may each have the same radius of curvature and the third and fourth corner portions may each have the same radius of curvature, the radius of curvature of the first and second corner portions being smaller than the radius of curvature of the third and fourth corner portions.

and for the rear gripping zone the first and second corner portions may have each the same radius of curvature and the third and fourth corner portions may each have the same radius of curvature, the radius of curvature of the first and second corner portions being greater than the radius of curvature of the third and fourth corner portion.

Alternatively, for example, in accordance with the present invention, for the forward gripping zone the first and second corner portions may each have the same radius of curvature and the fourth corner portion may have a radius of curvature greater than that of the third corner portion, the radius of curvature of the first and second corner portions also being smaller than the radius of curvature of the third and fourth corner portions.

and for the rear gripping zone the first corner portion may have a radius of curvature greater than that of the second corner portion and the fourth corner portion may have a radius of curvature greater than the third corner portion, the radius of curvature of the third and fourth corner portions being greater than the radius of curvature of the first and second corner portion.

In accordance with the present invention, the forward end of the handle may be configured so as to engage a blade in any suitable manner; such engagement may include a fixation which is permanent and a fixation which is releasable such that the blade (if broken) may be replaced. Reference may be made, for example, to the following patents which teach various types of known fixation techniques for fixing a blade to a handle so as to form a hockey stick; U.S. Pat. Nos. 3,934,875, 4,358,113, 4361,325 and 4,600,192.

Thus, in accordance with a particular aspect, the present invention provides a hockey stick comprising a handle of rectangular configuration having a rear end and a forward end, said forward end engaging a blade having a first (e.g. front) broad blade face and an opposed second (e.g. back) broad blade face, said handle being a handle of the present invention as defined herein and wherein the first and second broad sides of the handle merge respectively with the first and second broad blade faces of said blade. The broad sides of the handle may merge with the broad blade faces in any desired or known fashion; the merging may for example of occur in a sharp (e.g. perpendicular rise or fall) or a gradual (e.g. gentle falling or rising slope) fashion; see for example U.S. Pat. Nos. 4,358,113, and 5,312,100.

A concave, convex, or planar face of the forward gripping zone may extend forwardly along a respective broad side of the handle from a handle transition zone; similarly, a concave, convex, or planar face of the rear gripping zone may also extend rearwardly along a respective broad side of the handle from the transition zone. The transition zone of the handle is that part thereof across which, for example, a broad concave face becomes a convex face and vice-versa. The transition zone may of course take on any necessary or desired type of shape or length keeping in mind its function i.e. to link the two gripping zones together. The transition zone of a handle in accordance with the present invention may be one across which there may be a sharp (e.g. perpendicular rise or fall) or a gradual (e.g. gentle falling or rising slope) change in configuration for example from a concave to a convex face or from a convex to a concave face as the case may be. The transition zone of the handle may for example comprise a handle portion (e.g. a minor handle portion) comprising opposed first and second broad transition side faces wherein for example both of the opposed broad faces thereof are recessed (i.e. concave) or are non-recessed (e.g. both are planar or both are convex); the top and lower narrow side faces may for example both be planar, concave, convex etc. The transition zone may be abrupt (i.e. of very small length) or be relatively long as desired.

Advantageously, in accordance with the present invention, the configuration of the forward and rear gripping zones may be independently varied to take into account the individual preferences of a player, i.e. different grasping postures for each hand, desired handle feeling, etc..

A hockey stick provided with a handle of the present invention may provide a sense of a better or more comfortable feel on both of the gripped portions of the handle and/or a sense of a more comfortable and precise control of a blade which may be fixed to the end of such a handle, as compared with a hockey stick the handle of which is provided with (known) traditional flat broad faces which are identical to each other or with opposed faces as described in the above mentioned U.S. Pat. No. 5,423,531; e.g. for both gripping portions the convex curved surface may be seated in a portion of the palm of the hand while the finger tips of the hand are seated in the opposed recessed groove or concave face and vice-versa.

In accordance with the present invention, the arc of any concave faces and/or any convex faces may each be the same or different depending, for example, on the preferences of the intended user.

Thus, in accordance with the present invention the concave parts may have the same or different radius of curvature; the convex curved parts (if any) may have the same or different radius of curvature; the concave curved parts may have the same or different radius of curvature as any convexly curved part; and the like.

The radii of curvature of the aforementioned concave/convex parts, may have any number of values which provide the desired (enhanced) comfort and/or feeling on a palm area (or as the case may be the finger area) of a player's hand. The actual value of the radii of curvature desired to be used must, however, of course, be such that the (effective) value of the radii of curvature of any concave part and/or any convex part, provides the handle with the desired feeling (e.g. a thin or a thick feeling).

The depth of the recessed groove or concave face may be more or less the same (i.e. be uniform) along its entire length or else the depth may vary as desired; i.e. a radius of curvature may be more or less constant over an elongated length. Similarly, the radius of curvature may also vary along the length of the groove. In similar or analogous fashion the radius of curvature of a convex curved face may also as desired be varied along the elongated length therof.

It should be noted, however, that the possibility that the structure of the handle may be weakened increases as the radius of curvature of a concave face decreases, i.e. as the depth of a concave face increases relative to the adjacent corner portions. Accordingly, if a relatively small radius of curvature for a concave face is desired it may become necessary to take steps to reinforce the structure of the handle in any suitable (known) manner, e.g. by the use of a fibreglass/resin composite reinforcement layers, by appropriate choice of material of construction or the like.

Keeping the above in mind, In accordance with the present invention a the radii of curvature of the various elements of a hockey stick handle may for example have the following values:

a) concave face the concave face for the forward and rear gripping zones may have a radius of curvature of from 4 to 8 inches (10 to 21 cm) e.g. 6 to 7 inches e.g. 6.25 inches;

b) convex face the convex face for the forward and rear gripping zones may have a radius of curvature of from 2 to 6 inches (5 to 16 cm) e.g. 2.5 to 3.0 inches e.g. 2.815;

c) the forward gripping zone the first and second corner portions may have a radius of curvature of from 0.1 to 0.35 inches, e.g. 0.1 to 0.2 inches (2.5 to 5.1 mm) e.g. 0.156 inches;

the third and fourth corner portions may have a radius of curvature of from 0.1 to 0.35 inched, e.g. 0.15 inches to 0.35 inches (3.8 to 8.9 mm) e.g. 0.25 inches;

d) for the rear gripping zone the first and second corner portions may have a radius of curvature of from 0.1 to 0.35 inches, e.g. 15 inches to 0.35 inches (3.8 to 8.9 mm) e.g. 0.25 inches; and the third and fourth corner portions may have a radius of curvature of from 0.1 to 0.35 inches, e.g. 0.1 to 0.2 inches (2.5 to 5.1 mm) e.g. 0.156 inches.

The convex parts may, for example, having radii of curvature taking values the same as or greater than those assigned to the radii of curvature of the concave portions.

The ratio of the radius of curvature of a convex face to the radius of curvature of an adjacent corner portion connected thereto may for example be in the range of from 12:1 to 10:1 e.g. 11.5:11 to 10.5:1, e.g. 11.25:1.

The ratio of the radius of curvature of a concave face to the radius of curvature of an adjacent corner portion connected thereto may for example be in the range of from 35:1 to 45:1, e.g. 40:1.

In accordance with the present invention the narrow side faces may each be planar (i.e. more or less flat in configuration as described above).

In the figures which illustrate an example embodiment of the present invention,

Figure 1:
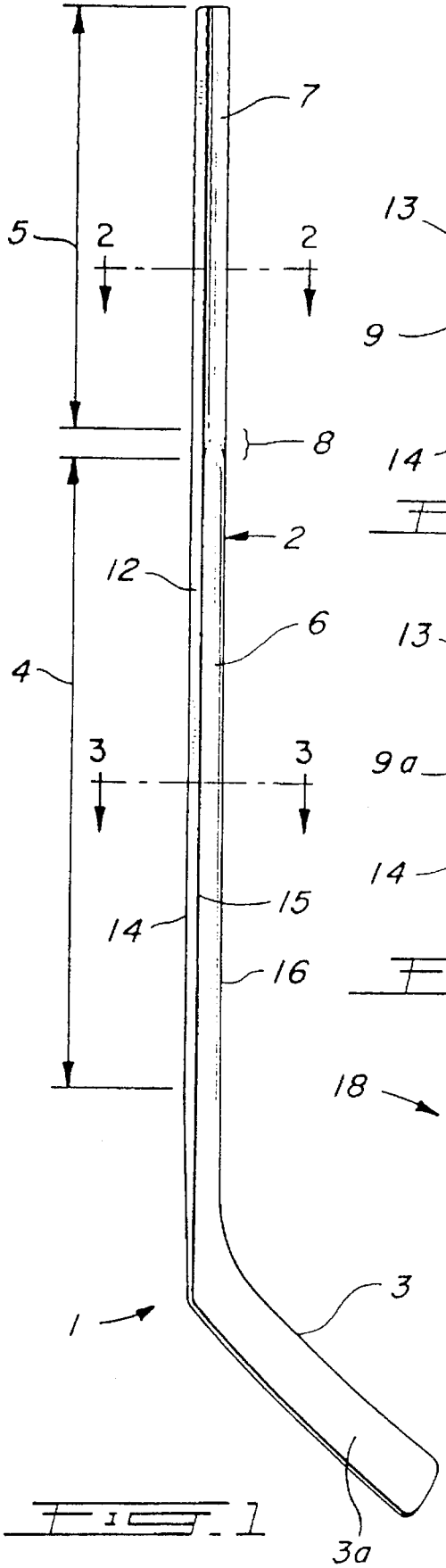
FIG. 1 is a perspective view of an example embodiment of a hockey stick having a example embodiment of a shaft or handle in accordance with the present invention which may be used by a right hand player.
Figure 2:
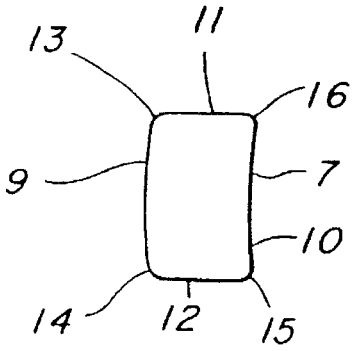
FIG. 2 is a transverse cross-sectional view corresponding to the cross-section at line 2—2 in FIG. 1.
Figure 3:
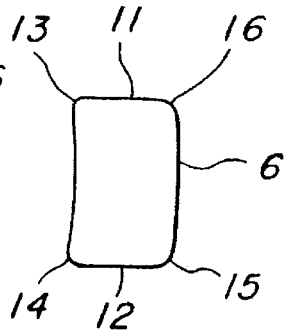
FIG. 3 is a transverse cross-sectional view corresponding to the cross-section at line 3—3 in FIG. 1.
Figure 6:
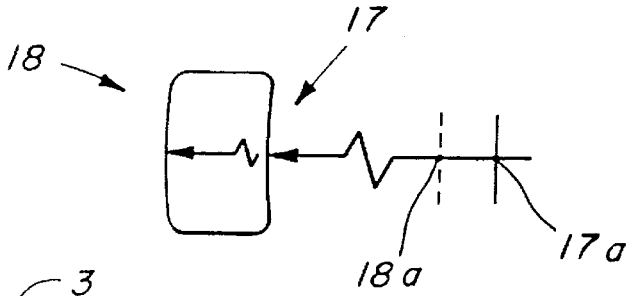
FIG. 6 is a transverse cross-sectional view of a gripping zone of a handle showing the center of radius for the arc of the concave and convex broad faces.
Figure 6A:
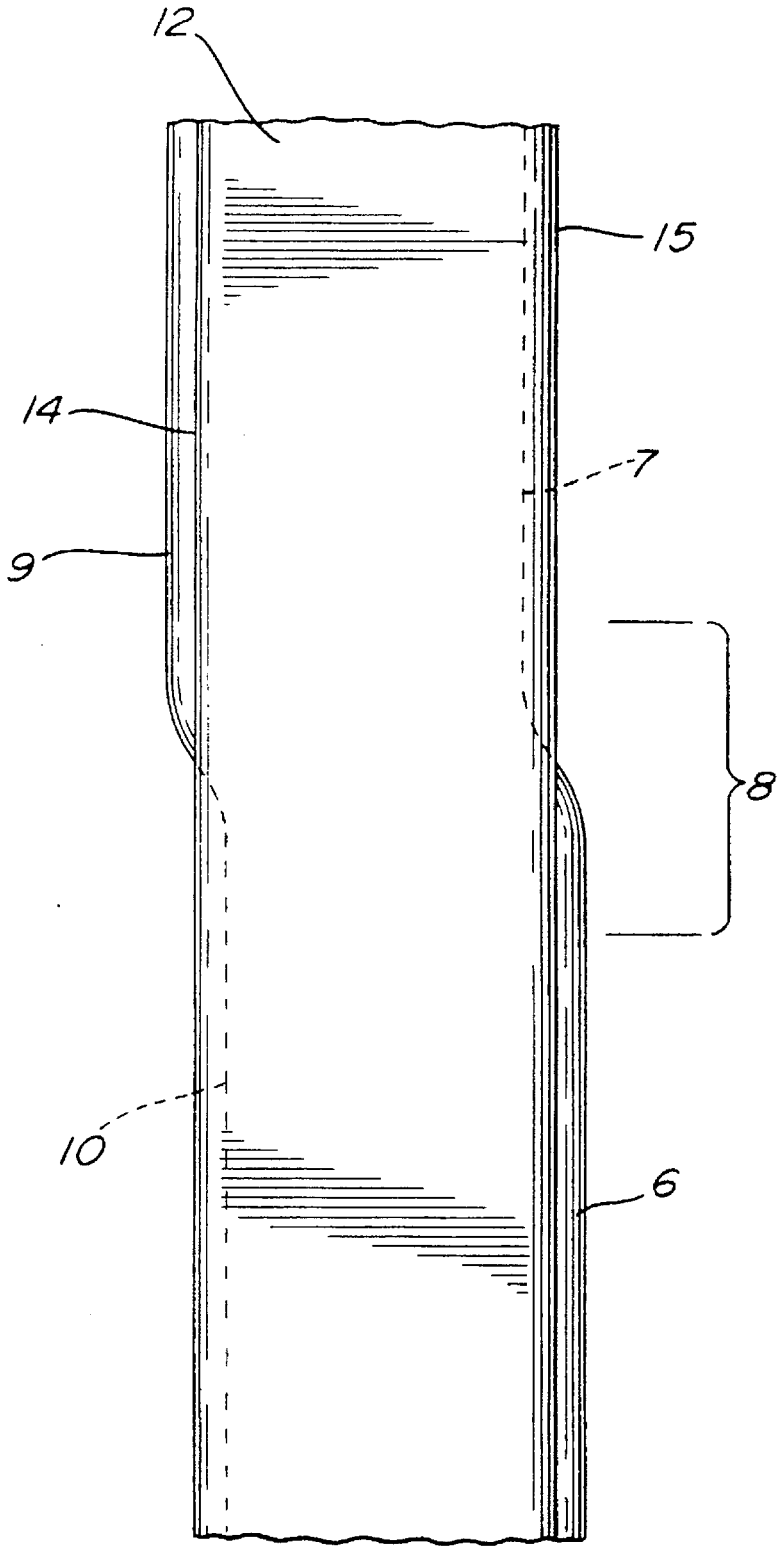
Figures 7, 8:
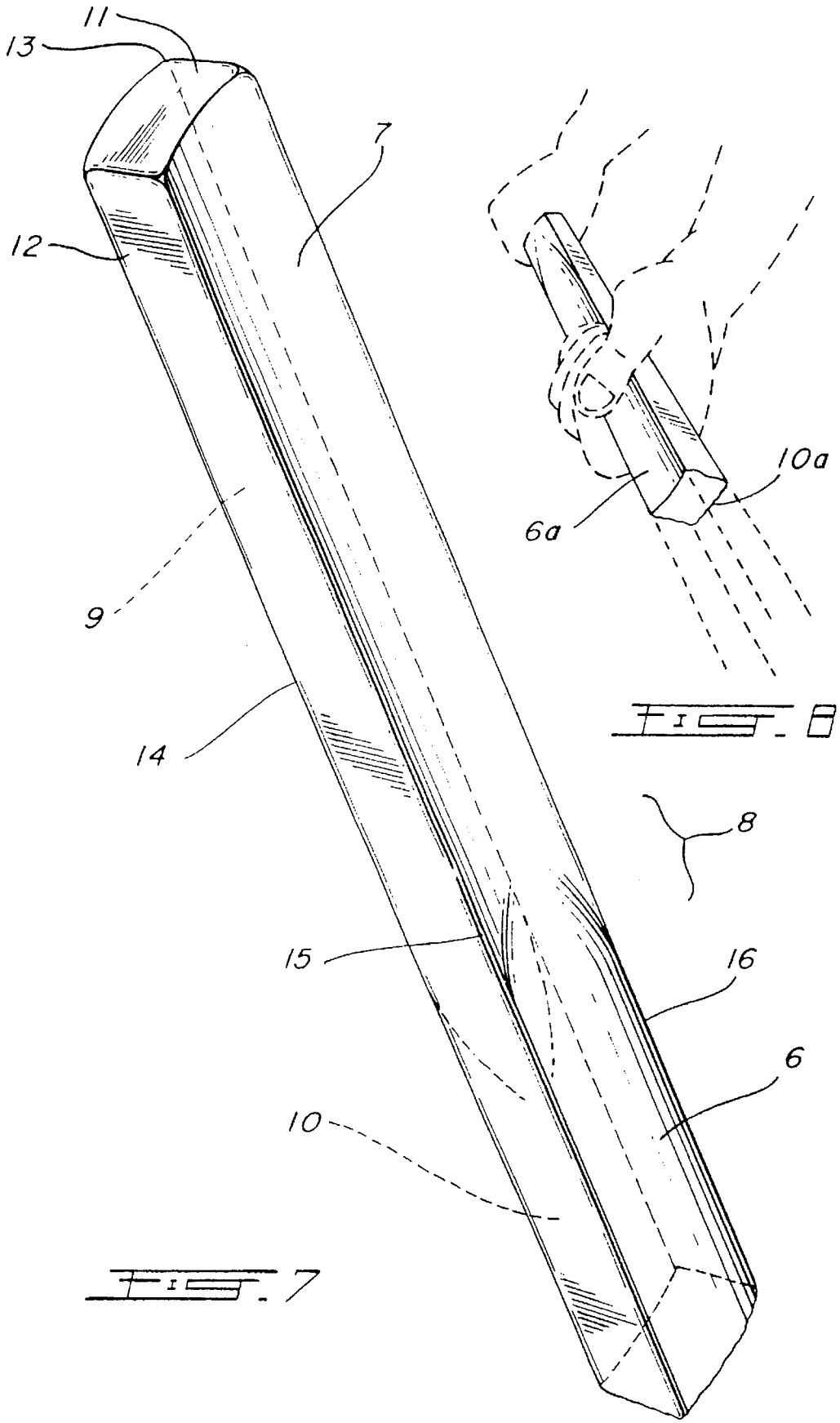
Figure 9:
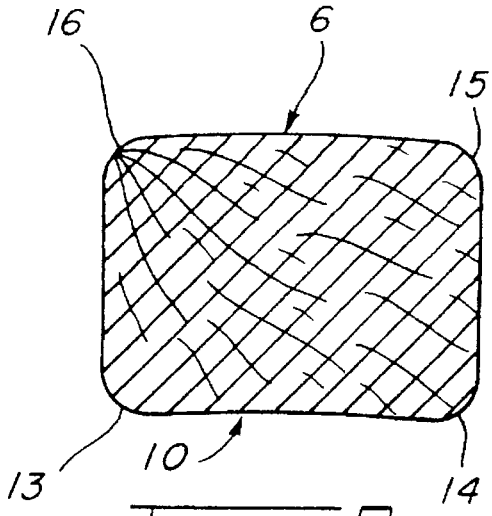
Figure 10:
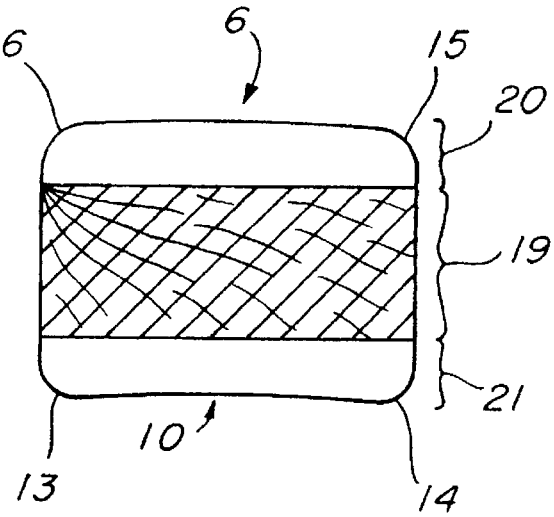
Figure 11:
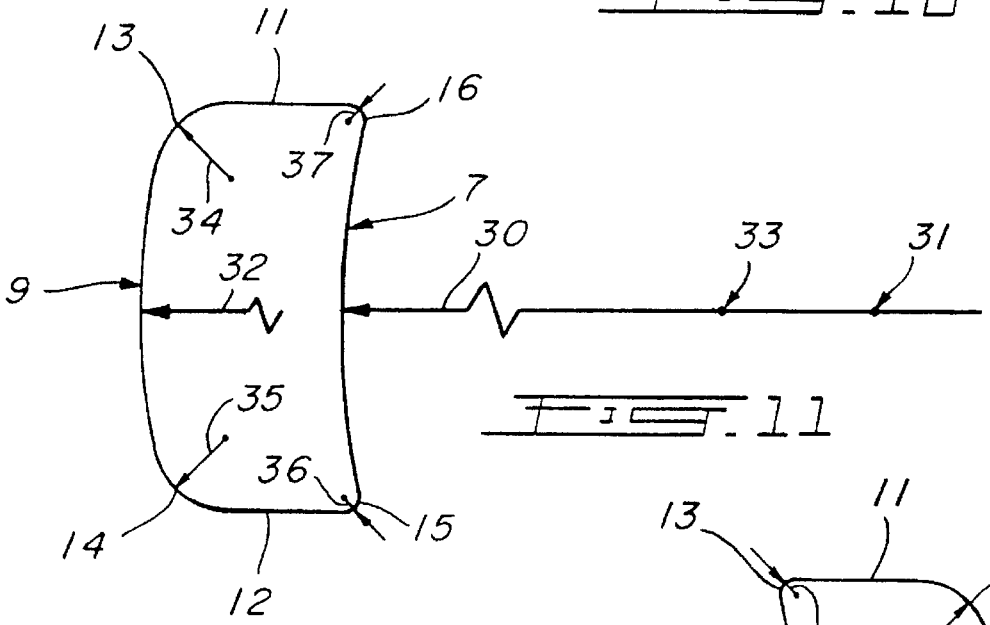
Figure 12:
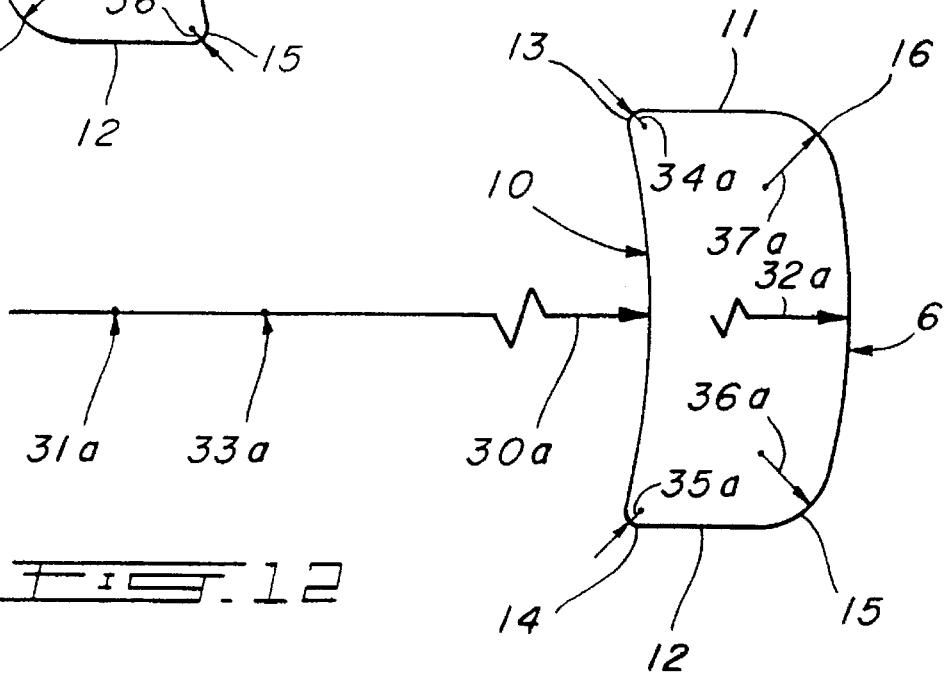
Figures 13, 14, 15, 16:
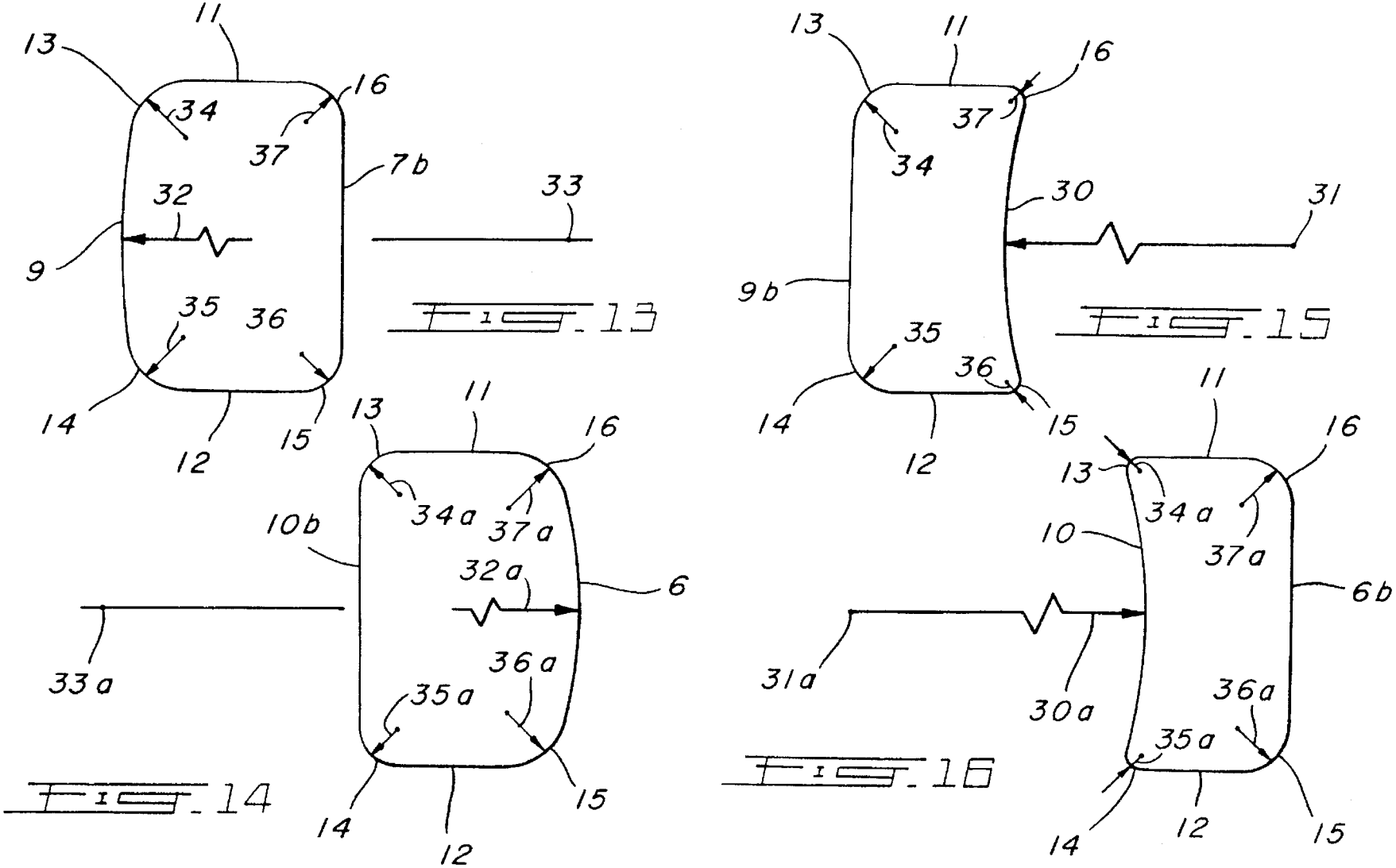

FIG. 6*a* is a rear schematic view of part of the handle of FIG. 1 showing in enlarged exaggerated view the transition zone thereof connecting the rear and forward gripping zones;

FIG. 7 is an enlarged schematic view of the rear gripping zone and a portion of the forward gripping zone of the right hand handle shown in FIG. 1;

FIG. 8 is a schematic view showing the position of the stick of FIG. 1 when gripped by a user;

FIG. 9 is a transverse cross-sectional view of a gripping zone of a handle of the present invention which is of wood;

FIG. 10 is a transverse cross-sectional view of a gripping zone of a handle of the present invention wherein the handle is a composite comprising a wood core sandwiched between opposed strips of reinforced material, e.g. a material reinforced by a fibre material such as glass fibres, carbon fibres, kevlar etc. . . . ;

FIG. 11 is an enlargement of the view shown in FIG. 2;

FIG. 12 is an enlargement of the view shown in figure 3;

FIG. 13 is the same view as shown in FIG. 11 but wherein the concave face has been replaced by a planar face;

FIG. 14 is the same view as shown in FIG. 12 but wherein the concave face has been replaced by a planar face;

FIG. 15 is the same view as shown in FIG. 11 but wherein the convex face has been replaced by a planar face; and FIG. 16 is the same view as shown in FIG. 12 but wherein the convex face has been replaced by a planar face.

Referring now to FIG. 1, a hockey stick 1 is shown which may be used by a "right hand" player and which comprises an upper elongated shaft or handle 2 which is attached to a blade 3. Apart from the configuration of the longitudinally extending corners (as shall be described hereinafter), the shaft 2 and the blade 3 may, for example, be of conventional wood or composite construction fixed together in any (known) manner. The blade has more less planar broad front and rear faces. The rear or back face 3*a* is shown with the front face being hidden therebehind; the front face is the face against which a hockey puck would usually impinge for a right hand player (i.e. during play). The blade could of course take on a curved aspect in which case the rear broad blade face 3*a* could for example have a convex aspect and the front broad blade face a corresponding concave aspect.

Shaft 2, as can be seen, is an elongated member of the stick. The shaft 2 has a rectangular configuration (i.e. viewed in cross-section, the shaft 2 provides a more or less rectangular aspect—see, for example FIGS. 2 and 3).

Shaft 2 has a forward gripping member or zone designated by the reference numeral 4 and a rear gripping member or zone designated by the reference numeral 5. The illustrated disposition and length of the gripping members or zones is of course given by way of example only; e.g. the forward and/or rear gripping members or zones 4 and 5 could be relatively shorter, as desired; the forward gripping zone could if desired extend right up to the heel of the blade.

Referring to FIGS. 1, 2 and 3, the shaft 2 includes a pair of opposed elongated non-planar broad sides. In FIG. 1 only the second broad side is explicitly shown; the first broad side being hidden from view on the opposite side of the stick 2. The first broad side merges with the broad front face of the blade whereas the second broad side merges with the back blade face 3*a*. Each of the opposed broad sides of the shaft or handle 2 includes an elongated recessed face part of concave transverse cross-section as well as an elongated face part of convex transverse cross-section (see FIGS. 2 and 3).

The second broad side which is visible from FIG. 1 has a forward convex portion 6 and a rear concave portion 7 (see FIGS. 2 and 3); the portion 6 is disposed in the forward gripping zone 4 and the portion 7 is disposed in the rear gripping zone 5. The portions 6 and 7 merge more or less smoothly together at a transition zone or zone indicated generally at 8 (see FIG. 6*a* for more detail).

The other hidden or first broad side of the handle 2 also includes a concave portion 9 and a convex portion 10 (see for example FIGS. 2 and 3). The concave portion 9 on the hidden side is disposed in the rear gripping zone 5; the convex portion 10 is disposed in the forward gripping zone 4. The portions 9 and 10 also merge more or less smoothly together at the transition member or zone 8 (see FIG. 6*a* for more detail).

Thus, as may be appreciated the forward gripping zone 4 comprises the convex portion 6 and the concave portion 10 which are disposed opposite each other. The rear gripping zone comprises the concave portion 7 and the convex portion 9 which are also disposed opposite each other. The forward and rear gripping zones thus have relative to each other a reversed configuration. In the illustrated embodiment the rear gripping zone extends right up to the rear end of the shaft 2; the forward gripping zone extends forwardly from the transition zone to a position just short of the forward end of the handle 2.

The handle or shaft 2 further includes a pair of opposed elongated planar narrow side faces 11 and 12. The handle or shaft 2 comprises first corner portion 13, second corner portion 14, third corner portion 15 and fourth corner portion 16.

FIG. 6*a* is rear schematic view of a portion of the shaft 2 which includes the transition zone 8, i.e. a view looking towards the lower narrow side 12 of the shaft. As seen in FIG. 6*a* the concave/convex transition on the first and second broad sides occurs more or less opposite one another.

However, if desired, the concave/convex transition on the first broad side may be offset relative to the concave/convex transition on the second broad side, i.e. the concave/convex transition on the second broad side may occur somewhat above or below the concave/convex transition on the opposite first broad side such that there may as desired be some overlap by a concave or convex curved face of the hidden side into an adjacent gripping zone.

The transition zone 8 could of course be longer or shorter, more gradual or sharper, etc. than that as shown (in FIGS. 1 and 6*a*) and could, for example, if desired, include opposed broad planar side faces which would of course merge with respective concave/convex faces.

Referring to FIGS. 1, 2 and 3, the visible broad side of the handle 2 comprising the curved faces 6 and 7 is respectively connected to the top narrow side 11 and lower narrower side 12 by the fourth corner portion 16 and the third corner portion 15 and whereas the hidden broad side face comprising the curved faces 9 and 10 is respectively connected to the narrow sides 11 and 12 by the first corner portion 13 and the second corner portion 14.

As seen, from FIGS. 2 and 3 the corner portions 13, 14, 15 and 16 are each rounded and each merges with the respective narrow and broad sides connected thereto. The corner portions are shown by way of example as having the configuration of a circular arc (i.e. as having radii of curvature); the corner portions could of course take any other suitable (know) shape, e.g. planar, squared, etc..

Figure 4:
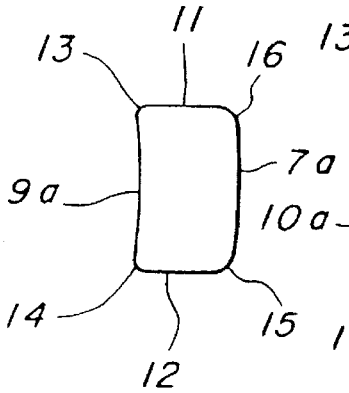
FIG. 4 is a transverse cross-sectional view corresponding to the cross-section at line 2—2 in FIG. 1 of a handle which may be used by a left hand player.
Figure 5:
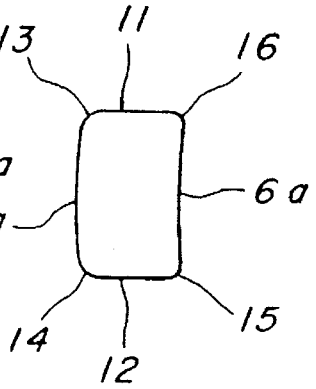
FIG. 5 is a transverse cross-sectional view corresponding to the cross-section at line 3—3 in FIG. 1 of a handle which may be used by a left hand player.

Turning to FIGS. 4 and 5, these figure respectively illustrate cross-sectional views taken along 2—2 and 3—3 of FIG. 1 but wherein the handle is an analogous handle which may be used by a left hand player; the same reference numerals are used to designate elements of the left hand version which are common with the right hand version shown in FIG. 1. The visible broad side face of the left hand version also has concave and convex curved portions 6*a* and 7*a* but the concave portion 6*a* is located in the forward gripping zone and the convex portion 7*a* is located in the rear gripping zone of the handle, i.e. the position of the concave and convex curves are reversed relative to the right hand version of the handle. The hidden broad face side likewise has reversed concave and convex curved portions, namely concave face 9*a* and convex face 10*a*.

Turning back to the stick as shown in FIGS. 1, 2 and 3, FIG. 6, shows, for illustration purposes, the centers of curvature for the concave face 17 and the convex face 18, namely centers 17*a* and 18*a* respectively.

In FIGS. 2 and 3 (as well as in FIGS. 4 and 5) The radius of curvature for each curved zone of the rear and forward pairs of elongated concave and convex faces are shown for illustration purposes as being the same. The curved faces could of course each have a different radius of curvature; preferably the radius of curvature of the concave side is greater than the radius of curvature of the opposes convex side. The radius of curvature of one pair of opposed curved faces may be different from that of the other pair; etc..

The radii of curvature of the aforementioned concave and convex faces can have any number of values as long as they provide the desired enhances comfort and feel on the finger and palm area of the hands.

In particular, the radius of curvature for each of the faces 6, 7, 9 and 10 (as well as for the faces 6*a*, 7*a*, 9*a* and 10*a*) may, for example, have a value selected from the above mentioned values. By way of example, the radii of curvature for each curved face may each be 8.375 inches.

From the foregoing, it can be appreciated that the elongated curved surfaces of the broad side faces of shaft 2, are sized so as to provide a comfortable hand grip fit for the fingers and the palm for each hand when the stick is being gripped by the user.

FIG. 7 shows an enlarged portion of the upper part of the handle of FIG. 1.

In the embodiment shown in the FIG. 1, the curved faces each extend more or less the entire length of a respective gripping zone, i.e. starting from a transition member or zone 8 forwardly or rearwardly. The curved faces need not, of course, extend the entire length of a gripping zone; they may, as desired, be limited to a shorter or different area of the gripping zones in accordance with the desires of an end-user.

Referring to FIG. 8, as may be seen the curved faces of the broad side faces of the handle rest (comfortably) up against the fingers as well as the palm area for both of the hands of a user. The finger tip area of the hands is cradled in the seat defined by the concave faces for providing the user with a precise feel of the shaft for control of any blade (not shown) disposed at the end thereof. As may be appreciated from FIG. 8 not only is the configuration of the forward end of the handle adapted to suit a player's right hand but the same is so for the player's left hand which grips the rear part of the stick.

A handle in accordance with the present invention may be made of any suitable (known) material. It may, for example, be made of wood, of a light metal such as aluminum, of a composite material (e.g. a fibreglass composite, a wood/fibreglass composite, a graphite composite or the like), etc. FIG. 9 illustrates a handle made of wood. FIG. 10 illustrates a composite type handle which has a central wood core 19 sandwiched between fibre reinforced broad side elements 20 and 21; the fibre reinforced elements 20 and 21 define the necessary curved faces of the broad side faces.

A handle of the present invention may, for example, be formed by first forming a hockey stick shaft with more or less planar broad faces and thereafter shaving or sanding the broad faces to the desired arc configuration as described herein. Alternatively, if the handle is to be of a composite fibre reinforced material, the moulding process (i.e. mould) may take into account the desired curved faces as described herein.

U.S. Pat. No. 4,200,479 for example shows how to make a hockey stick wherein strips of reinforcing plastic materials are fixed to the broad side faces of a hockey stick handle; the illustrated process could for example be adapted to provide for hockey sticks in accordance with the present invention.

Turning to FIGS. 11 and 12, these figures are respectively enlarged versions of FIGS. 2 and 3 but wherein various radii of curvature and centers of curvature are schematically shown.

Referring to FIG. 11, this figure illustrates, as mentioned above, the cross section of the rear gripping zone 5 (see section 2—2 in FIG. 1). The radius of curvature and center of curvature for the concave face 7 are respectively designated as 30 and 31; the radius of curvature and center of curvature for the convex face 9 are respectively designated as 32 and 33.

The radius of curvature for the first corner portion 13 is designated as 34; the radius of curvature for the second corner portion 14 is designated as 35; the radius of curvature for the third corner portion 15 is designated as 36; and the radius of curvature for the fourth corner portion 16 is designated as 37.

The radii of curvature 30 and 32 may have the values mentioned above. The radius of curvature 30 for the concave face 7 is shown as being more or less equal to the radius of curvature 32 of the convex face 9. However, the radius of curvature 30 is preferably larger than the radius of curvature 32 so as to accentuate the hollow feeling of the concave face and the full feeling of the convex face. Thus, for example, the concave radius of curvature 30 may have a value selected from the range comprising 6 to 7 inches (e.g. 6.25 inches) and the convex radius of curvature 32 may have a value selected from the range comprising 2.5 to 3.0 inches (e.g. 2.815 inches).

The radius of curvature 34 for the first corner portion 13 is shown as being larger than the radius of curvature 37 for the fourth corner portion 16; similarly, the radius of curvature 35 for the second corner portion 14 is shown as being larger than the radius of curvature 36 for the third corner portion 15.

The radii of curvature 34 and 35 are shown as being the same and the radii of curvature 36 and 37 are also shown as being the same. The radius of curvature 34 may, however, as desired be greater than or smaller than the radius of curvature 35 keeping in mind the comfort and stick control factors. Similarly, the radius of curvature 37 may, however, as desired be greater than or smaller than the radius of curvature 36, again keeping in mind the comfort and stick control factors.

If desired, the radius 34 may be larger than the radii 35, 36 and 37; the radius 37 may be larger than the radii 35 and 36.

The radii of curvature 36 and 37 may for example have a value selected from the range comprising 0.1 to 0.2 inches (e.g. 0.156 inches). The radii of curvature 37 and 38 may for example have a value selected from the range comprising 0.15 to 0.35 inches (e.g. 0.25 inches).

Referring to FIG. 12, this figure illustrates, as mentioned above, the cross section of a forward gripping zone 4 (see section 3—3 in FIG. 1). The radius of curvature and center of curvature for the concave face 10 are respectively designated as 30*a* and 31*a;* the radius of curvature and center of curvature for the convex face 6 are respectively designated as 32*a* and 33*a*.

The radius of curvature for the first corner portion 13 is designated as 34*a;* the radius of curvature for the second corner portion 14 is designated as 35*a;* the radius of curvature for the third corner portion 15 is designated as 36*a;* and the radius of curvature for the first corner portion 16 is designated as 37*a*.

The radii of curvature 30*a* and 32*a* may have the values mentioned above. The radius of curvature 30*a* for the concave face 10 is shown as being more or less equal to the radius of curvature 32*a* of the convex face 6. However, in analogous fashion with respect to the corresponding radii of FIG. 11, the radius of curvature 30*a* is preferably larger than the radius of curvature 32*a* so as to accentuate the hollow feeling of the concave face and the full feeling of the convex face. Thus, for example, the concave radius of curvature 30*a* may have a value selected from the range comprising 6 to 7 inches (e.g. 6.25 inches) and the convex radius of curvature 32*a* may have a value selected from the range comprising 2.5 to 3.0 inches (e.g. 2.815 inches).

The radius of curvature 34*a* for the first corner portion 13 is shown as being smaller than the radius of curvature 37*a* for the fourth corner portion 16; similarly, the radius of curvature 35*a* for the second corner portion 14 is shown as being smaller than the radius of curvature 36*a* for the third corner portion 15.

The radii of curvature 34*a* and 35*a* are shown as being the same and the radii of curvature 36*a* and 37*a* are also shown as being the same. The radius of curvature 34*a* may, however, as desired be greater than or smaller than the radius of curvature 35*a* keeping in mind the comfort and stick control factors. Similarly, the radius of curvature 37*a* may, however, as desired be greater than or smaller than the radius of curvature 36*a*, again keeping in mind the comfort and stick control factors.

If desired, the radius 37*a* may be larger than the radii 34*a*, 35*a* and 36*a;* the radius 34*a* may be larger than the radii 35 and 36*a*.

The radii of curvature 34*a* and 35*a* may for example have a value selected from the range comprising 0.1 to 0.2 inches (e.g. 0.156 inches). the radii of curvature 36*a* and 37*a* may for example have a value selected from the range comprising 0.15 to 0.35 inches (e.g. 0.25 inches).

As mentioned above FIGS. 1, 2, 3, 11 and 12 relate to a hockey stick which may be used by a "right hand" player, FIG. 11 being an enlarged view of FIG. 2 and FIG. 12 being an enlarged view of FIG. 3; this stick could of course, if desired, be used by a left hand player.

On the other hand, in the case of an analogous handle having similarly configured forward and rear gripping zones which may be used by a "left hand" player, FIG. 11 would reflect an enlarged view of FIG. 5 whereas FIG. 12 would reflect an enlarged view of FIG. 4. Keeping this in mind, therefor, the above comments with respect to FIGS. 11 and 12 may be applied in analogous fashion to such an analogous handle which may be used by a "left hand" player, i.e. in relation to FIGS. 4 and 5.

As mentioned a blade may have a curved aspect, i.e. it may have an inside concave broad face which usually is used to impact a puck and an outside convex rear or back broad face. A curved blade may be a "right hand" blade or a "left hand" blade. In relation to either of such blades, the handle may have the cross section shown in FIGS. 2 and 3 or alternatively as desired it may have the cross section as shown in FIGS. 4 and 5 who may prefer the feel of such a handle.

FIGS. 1 to 12 relate to handles wherein the elongated faces of each gripping zone comprises a pair of convex and concave faces. However, as mentioned above an elongated face of a gripping zone may have a planar configuration.

Turning to FIGS. 13 and 14 these figures illustrate the same views as shown in FIGS. 11 and 12 but wherein the concave faces have been replaced by planar faces. Thus the same reference numerals have been used to designate the common elements. As may be seen the concave faces 7 and 10 in FIGS. 11 and 12 have been replaced in FIGS. 13 and 14 by the planar faces 7*b* and 10*b*. Apart from these planar faces the above comments with respect to FIGS. 11 and 12 apply in analogous fashion to FIGS. 13 and 14.

Turning to FIGS. 15 and 16 these figures illustrate the same views as shown in FIGS. 11 and 12 but wherein the convex faces have been replaced by planar faces. Thus the same reference numerals have been used to designate the common elements. As may be seen the convex faces 6 and 9 in FIGS. 11 and 12 have been replaced in FIGS. 15 and 16 by the planar faces 6*b* and 9*b*. Apart from these planar faces the above comments with respect to FIGS. 11 and 12 apply in analogous fashion to FIGS. 15 and 16.

The embodiments of the invention in which an exclusive property or privilege is claimed are as follows:

1. A hockey stick handle of rectangular configuration having a rear end and a forward end, said forward end being configured for engaging a blade having a first broad blade face and an opposed second broad blade face, said handle having, a pair of opposed narrow sides comprising a top narrow side and a lower narrow side, a pair of opposed broad sides comprising a first broad side and a second broad side, the first and second broad sides being configured to merge respectively with the first and second broad blade faces of a said blade for forming a hockey stick comprising said handle and said blade the improvement wherein said handle comprises a forward gripping zone for being gripped by one hand of a user a rear gripping zone for being gripped by the user's other hand and an intermediate transition zone connecting the forward and rear gripping zones together, said forward gripping zone comprising a first forward elongated face and a second forward elongated face, each of said forward faces extending forwardly from said transition zone, each of said forward faces being independently selected from the group of configurations comprising a forward elongated concave face, a forward elongated convex face and a forward elongated planar face, said rear gripping zone comprising a first rear elongated face and a second rear elongated face, each of said rear faces extending rearwardly from said transition zone, each of said rear faces being independently selected from the group of configurations comprising a rear elongated concave face, a rear elongated convex face and a rear elongated planar face, said first broad side comprising the first forward elongated face and the second rear elongated face, said second broad side comprising the second forward elongated face and the first rear elongated face, the first forward elongated face of the forward gripping zone having a configuration different from that of the second forward elongated face of the forward gripping zone, the first rear elongated face of the rear gripping zone having a configuration different from that of the second rear elongated face of the rear gripping zone, the forward elongated face of the first broad side having a configuration different from that of the rear elongated face of the first broad side, and the forward elongated face of the second broad side having a configuration different from that of the rear elongated face of the second broad side.

2. A hockey stick handle as defined in claim 1, wherein, for each of the gripping zones, one of the elongated faces thereof has a planar configuration and the other elongated face thereof has a different configuration.

3. A hockey stick handle as defined in claim 1, wherein a first corner portion connects the first broad side to the top narrower side, a second corner portion connects the first broad side to the lower narrow side, a third corner portion connects the second broad side to the lower narrow side, and a fourth corner portion connects the second broad side to the top narrow side wherein for the forward gripping zone the first corner portion has a radius of curvature greater than the fourth corner portion, wherein for the rear gripping zone the first corner portion has a radius of curvature smaller than the fourth corner portion.

4. A hockey stick handle as defined in claim 3 wherein for the forward gripping zone the second corner portion has a radius of curvature greater than the third corner portion, wherein for the rear gripping zone the second corner portion has a radius of curvature smaller than the third corner portion.

5. A hockey stick comprising a handle of rectangular configuration having a rear end and a forward end, said forward end engaging a blade having a first broad blade face and an opposed second broad blade face, said handle having, a pair of opposed narrow sides comprising a top narrow side and a lower narrow side, a pair of opposed broad sides comprising a first broad side and a second broad side, the first and second broad sides merging respectively with said first and second broad blade faces of said blade, the improvement wherein said handle comprises a forward gripping zone for being gripped by one hand of a user a rear gripping zone for being gripped by the user's other hand and an intermediate transition zone connecting the forward and rear gripping zones together, said forward gripping zone comprising a first forward elongated face and a second forward elongated face, each of said forward faces extending forwardly from said transition zone, each of said forward faces being independently selected from the group of configurations comprising a forward elongated concave face, a forward elongated convex face and a forward elongated planar face, said rear gripping zone comprising a first rear elongated face and a second rear elongated face, each of said rear faces extending rearwardly from said transition zone, each of said rear forward faces being independently selected from the group of configurations comprising a rear elongated concave face, a rear elongated convex face and a rear elongated planar face, said first broad side comprising the first forward elongated face and the second rear elongated face, said second broad side comprising the second forward elongated face and the first rear elongated face, the first forward elongated face of the forward gripping zone having a configuration different from that of the second forward elongated face of the forward gripping zone, the first rear elongated face of the rear gripping zone having a configuration different from that of the second rear elongated face of the rear gripping zone, the forward elongated face of the first broad side having a configuration different from that of the rear elongated face of the first broad side, and the forward elongated face of the second broad side having a configuration different from that of the rear elongated face of the second broad side.

6. A hockey stick as defined in claim 5, wherein a first corner portion connects the first broad side to the top narrower side, a second corner portion connects the first broad side to the lower narrow side, a third corner portion connects the second broad side to the lower narrow side, and a fourth corner portion connects the second broad side to the top narrow side wherein for the forward gripping zone the first corner portion has a radius of curvature greater than the fourth corner portion, wherein for the rear gripping zone the first corner portion has a radius of curvature smaller than the fourth corner portion.

7. A hockey stick as defined in claim 6 wherein wherein for the forward gripping zone the second corner portion has a radius of curvature greater than the third corner portion, wherein for the rear gripping zone the second corner portion has a radius of curvature smaller than the third corner portion.

8. A hockey stick handle of rectangular configuration having a rear end and a forward end, said forward end being configured for engaging a blade having a first broad blade face and an opposed second broad blade face, said handle having, a pair of opposed narrow sides comprising a top narrow side and a lower narrow side, a pair of opposed broad sides comprising a first broad side and a second broad side, the first and second broad sides being configured to merge respectively with the first and second broad blade faces of a said blade, for forming a hockey stick comprising said handle and said blade the improvement wherein said handle comprises a forward gripping zone for being gripped by one hand of a user a rear gripping zone for being gripped by the user's other hand and an intermediate transition zone connecting the forward and rear gripping zones together, said forward gripping zone comprising a forward elongated concave face and a forward elongated convex face, each of said forward faces extending forwardly from said transition zone, said rear gripping zone comprising a rear elongated concave face and a rear elongated convex face, each of said rear faces extending rearwardly from said transition zone, said first broad side comprising the forward elongated concave face and the rear elongated convex face, said second broad side comprising the forward elongated convex face and the rear elongated concave face.

9. A hockey stick handle as defined in claim 8 wherein the concave face of the forward gripping zone has a radius of curvature larger than the radius of curvature of the convex face thereof and wherein the concave face of the rear gripping zone has a radius of curvature larger than the radius of curvature of the convex face thereof.

10. A hockey stick handle as defined in claim 9 wherein the concave face of the forward gripping zone has a radius of curvature the same as the radius of curvature of the concave face of the rear gripping zone.

11. A hockey stick handle as defined in claim 9, wherein a first corner portion connects the first broad side to the top narrower side, a second corner portion connects the first broad side to the lower narrow side, a third corner portion connects the second broad side to the lower narrow side, and a fourth corner portion connects the second broad side to the top narrow side wherein for the forward gripping zone the first corner portion has a radius of curvature greater than the fourth corner portion, wherein for the rear gripping zone the first corner portion has a radius of curvature smaller than the fourth corner portion.

12. A hockey stick handle as defined in claim 11 wherein wherein for the forward gripping zone the second corner portion has a radius of curvature greater than the third corner portion, wherein for the rear gripping zone the second corner portion has a radius of curvature smaller than the third corner portion.

13. A hockey stick comprising a handle of rectangular configuration having a rear end and a forward end, said forward end engaging a blade having a first broad blade face and an opposed second broad blade face, said handle having, a pair of opposed narrow sides comprising a top narrow side and a lower narrow side, a pair of opposed broad sides comprising a first broad side and a second broad side, the first and second broad sides merging respectively with said first and second broad blade faces of said blade, the improvement wherein said handle comprises a forward gripping zone for being gripped by one hand of a user a rear gripping zone for being gripped by the user's other hand and an intermediate transition zone connecting the forward and rear gripping zones together, said forward gripping zone comprising a forward elongated concave face and a forward elongated convex face, each of said forward faces extending forwardly from said transition zone, said rear gripping zone comprising a rear elongated concave face and a rear elongated convex face, each of said rear faces extending rearwardly from said transition zone, said first broad side comprising the forward elongated concave face and the rear elongated convex face, said second broad side comprising the forward elongated convex face and the rear elongated concave face.

14. A hockey stick as defined in claim 13 wherein the concave face of the forward gripping zone has a radius of curvature larger than the radius of curvature of the convex face thereof and wherein the concave face of the rear gripping zone has a radius of curvature larger than the radius of curvature of the convex face thereof.

15. A hockey stick as defined in claim 14 wherein the concave face of the forward gripping zone has a radius of curvature the same as the radius of curvature of the concave face of the rear gripping zone.

16. A hockey stick as defined in claim 14, wherein a first corner portion connects the first broad side to the top narrower side, a second corner portion connects the first broad side to the lower narrow side, a third corner portion connects the second broad side to the lower narrow side, and a fourth corner portion connects the second broad side to the top narrow side wherein for the forward gripping zone the first corner portion has a radius of curvature greater than the fourth corner portion, wherein for the rear gripping zone the first corner portion has a radius of curvature smaller than the fourth corner portion.

17. A hockey stick as defined in claim 16 wherein wherein for the forward gripping zone the second corner portion has a radius of curvature greater than the third corner portion, wherein for the rear gripping zone the second corner portion has a radius of curvature smaller than the third corner portion.

18. A hockey stick handle of rectangular configuration having a rear end and a forward end, said forward end being configured for engaging a blade having a first broad blade face and an opposed second broad blade face, ps said handle having, a pair of opposed narrow sides comprising a top narrow side and a lower narrow side, a pair of opposed broad sides comprising a first broad side and a second broad side, the first and second broad side being configured to merge respectively with the first and second broad blade faces of a said blade for forming a hockey stick comprising said handle and said blade the improvement wherein said handle comprises a forward gripping zone for being gripped by one hand of a user a rear gripping zone for being gripped by the user's other hand and an intermediate transition zone connecting the forward and rear gripping zones together, said forward gripping zone comprising a forward elongated planar face and a forward elongated convex face, each of said forward faces extending forwardly from said transition zone, said rear gripping zone comprising a rear elongated planar face and a rear elongated convex face, each of said rear faces extending rearwardly from said transition zone, said first broad side comprising the forward elongated planar face and the rear elongated convex face, said second broad side comprising the forward elongated convex face and the rear elongated planar face.

19. A hockey stick handle as defined in claim 18, wherein a first corner portion connects the first broad side to the top narrower side, a second corner portion connects the first broad side to the lower narrow side, a third corner portion connects the second broad side to the lower narrow side, and a fourth corner portion connects the second broad side to the top narrow side wherein for the forward gripping zone the first corner portion has a radius of curvature greater than the fourth corner portion, wherein for the rear gripping zone the first corner portion has a radius of curvature smaller than the fourth corner portion.

20. A hockey stick handle as defined in claim 19 wherein wherein for the forward gripping zone the second corner portion has a radius of curvature greater than the third corner portion, wherein for the rear gripping zone the second corner portion has a radius of curvature smaller than the third corner portion.

21. A hockey stick comprising a handle of rectangular configuration having a rear end and a forward end, said forward end engaging a blade having a first broad blade face and an opposed second broad blade face, said handle having, a pair of opposed narrow sides comprising a top narrow side and a lower narrow side, a pair of opposed broad sides comprising a first broad side and a second broad side, the first and second broad sides merging respectively with said first and second broad blade faces of said blade, the improvement wherein said handle comprises a forward gripping zone for being gripped by one hand of a user a rear gripping zone for being gripped by the user's other hand and an intermediate transition zone connecting the forward and rear gripping zones together, said forward gripping zone comprising a forward elongated planar face and a forward elongated convex face, each of said forward faces extending forwardly from said transition zone, said rear gripping zone comprising a rear elongated planar face and a rear elongated convex face, each of said rear faces extending rearwardly from said transition zone, said first broad side comprising the forward elongated planar face and the rear elongated convex face, said second broad side comprising the forward elongated convex face and the rear elongated planar face.

22. A hockey stick as defined in claim 21, wherein a first corner portion connects the first broad side to the top narrower side, a second corner portion connects the first broad side to the lower narrow side, a third corner portion connects the second broad side to the lower narrow side, and a fourth corner portion connects the second broad side to the top narrow side wherein for the forward gripping zone the first corner portion has a radius of curvature greater than the fourth corner portion, wherein for the rear gripping zone the first corner portion has a radius of curvature smaller than the fourth corner portion.

23. A hockey stick as defined in claim 22 wherein wherein for the forward gripping zone the second corner portion has a radius of curvature greater than the third corner portion, wherein for the rear gripping zone the second corner portion has a radius of curvature smaller than the third corner portion.

24. A hockey stick handle of rectangular configuration having a rear end and a forward end, said forward end being configured for engaging a blade having a first broad blade face and an opposed second broad blade face, said handle having, a pair of opposed narrow sides comprising a top narrow side and a lower narrow side, a pair of opposed broad sides comprising a first broad side and a second broad side, the first and second broad side being configured to merge respectively with the first and second broad blade faces of a said blade for forming a hockey stick comprising said handle and said blade the improvement wherein said handle comprises a forward gripping zone for being gripped by one hand of a user a rear gripping zone for being gripped by the user's other hand and an intermediate transition zone connecting the forward and rear gripping zones together, said forward gripping zone comprising a forward elongated concave face and a forward elongated planar face, each of said forward faces extending forwardly from said transition zone, said rear gripping zone comprising a rear elongated concave face and a rear elongated planar face, each of said rear faces extending rearwardly from said transition zone, said first broad side comprising the forward elongated concave face and the rear elongated planar face, the second broad side comprising the forward elongated planar face and the rear elongated concave face.

25. A hockey stick handle as defined in claim 24, wherein a first corner portion connects the first broad side to the top narrower side, a second corner portion connects the first broad side to the lower narrow side, a third corner portion connects the second broad side to the lower narrow side, and a fourth corner portion connects the second broad side to the top narrow side wherein for the forward gripping zone the first corner portion has a radius of curvature greater than the fourth corner portion, wherein for the rear gripping zone the first corner portion has a radius of curvature smaller than the fourth corner portion.

26. A hockey stick handle as defined in claim 25 wherein wherein for the forward gripping zone the second corner portion has a radius of curvature greater than the third corner portion, wherein for the rear gripping zone the second corner portion has a radius of curvature smaller than the third corner portion.

27. A hockey stick comprising a handle of rectangular configuration having a rear end and a forward end, said forward end engaging a blade having a first broad blade face and an opposed second broad blade face, said handle having, a pair of opposed narrow sides comprising a top narrow side and a lower narrow side, a pair of opposed broad sides comprising a first broad side and a second broad side, the first and second broad sides merging respectively with said first and second broad blade faces of said blade, the improvement wherein said handle comprises a forward gripping zone for being gripped by one hand of a user a rear gripping zone for being gripped by the user's other hand and an intermediate transition zone connecting the forward and rear gripping zones together, said forward gripping zone comprising a forward elongated concave face and a forward elongated planar face, each of said forward faces extending forwardly from said transition zone, said rear gripping zone comprising a rear elongated concave face and a rear elongated planar face, each of said rear faces extending rearwardly from said transition zone, said first broad side comprising the forward elongated concave face and the rear elongated planar face, said second broad side comprising the forward elongated planar face and the rear elongated concave face.

28. A hockey stick as defined in claim 27, wherein a first corner portion connects the first broad side to the top narrower side, a second corner portion connects the first broad side to the lower narrow side, a third corner portion connects the second broad side to the lower narrow side, and a fourth corner portion connects the second broad side to the top narrow side wherein for the forward gripping zone the first corner portion has a radius of curvature greater than the fourth corner portion, wherein for the rear gripping zone the first corner portion has a radius of curvature smaller than the fourth corner portion.

29. A hockey stick as defined in claim 28 wherein wherein for the forward gripping zone the second corner portion has a radius of curvature greater than the third corner portion, wherein for the rear gripping zone the second corner portion has a radius of curvature smaller than the third corner portion.

* * * * *